US007834826B2

(12) United States Patent
Kwon

(10) Patent No.: US 7,834,826 B2
(45) Date of Patent: Nov. 16, 2010

(54) ORGANIC LIGHT EMITTING DISPLAY DEVICE WITH IMPROVED LUMINANCE UNIFORMITY BY USING A FEEDBACK SIGNAL AND DRIVING METHOD OF THE SAME

(75) Inventor: Oh Kyong Kwon, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 902 days.

(21) Appl. No.: 11/601,180

(22) Filed: Nov. 16, 2006

(65) Prior Publication Data

US 2007/0200804 A1 Aug. 30, 2007

(30) Foreign Application Priority Data

Feb. 28, 2006 (KR) ..... 10-2006-0019354

(51) Int. Cl.
*G09G 3/30* (2006.01)

(52) U.S. Cl. ..... 345/77; 345/82

(58) Field of Classification Search ..... 345/76, 345/77–78; 315/169.3
See application file for complete search history.

(56) References Cited

U.S. PATENT DOCUMENTS 6,229,508 B1 * 5/2001 Kane ..... 345/82
2002/0089357 A1 * 7/2002 Pae et al. ..... 327/112
2003/0030603 A1 * 2/2003 Shimoda ..... 345/76
2005/0116654 A1 * 6/2005 Sato et al. ..... 315/169.2
2006/0256048 A1 * 11/2006 Fish et al. ..... 345/81

FOREIGN PATENT DOCUMENTS

CN 1363916 A 8/2002
EP 1 221 686 A2 7/2002

(Continued)

OTHER PUBLICATIONS

Extended European Search Report for corresponding European Patent Application No. 07250835.1, dated Sep. 3, 2008.

(Continued)

*Primary Examiner*—Chanh Nguyen
*Assistant Examiner*—Long Pham
(74) *Attorney, Agent, or Firm*—Christie, Parker & Hale, LLP

(57) ABSTRACT

An organic light emitting display device and a driving method for the same is provided. The device includes a data driver that can cause a display of an image having a uniform luminance. The data driver includes a ramp pulse generating part for generating a ramp pulse. The data driver also includes a current digital-to-analog converting part for generating a data current using data provided to the data driver. The data driver also includes a current control part for providing the ramp pulse to data lines coupled to a pixel and comparing a pixel current from the pixel with the data current to control providing of the ramp pulse to the data lines. The pixel current corresponds to the ramp pulse.

20 Claims, 8 Drawing Sheets

FOREIGN PATENT DOCUMENTS

| | | | |
|---|---|---|---|
| EP | 1 221 686 | A3 | 3/2003 |
| JP | 2004-192000 | | 7/2004 |
| JP | 2005-134640 | | 5/2005 |
| KR | 10-2005-0035550 | | 4/2005 |
| WO | WO 2005/022498 | * | 3/2005 |

OTHER PUBLICATIONS

Korean Patent Abstracts, Publication No. 1020050035550 A, Published on Apr. 19, 2005, in the name of Chien et al.

First Office Action for related Chinese Patent Application No. 2007100042220 dated Oct. 10, 2008 with English translation of text.

Japanese Office action dated Dec. 8, 2009, for corresponding Japanese application 2006-192865, EP 1 221 686 previously filed in an IDS dated Nov. 3, 2008.

Japanese Office Action dated May 11, 2010 of the corresponding Japanese Patent Application No. 2006-192865, noting listed reference in this IDS.

* cited by examiner

ORGANIC LIGHT EMITTING DISPLAY DEVICE WITH IMPROVED LUMINANCE UNIFORMITY BY USING A FEEDBACK SIGNAL AND DRIVING METHOD OF THE SAME

CROSS-REFERENCE TO RELATED APPLICATIONS

This application claims priority to and the benefit of Korean Patent Application No. 10-2006-0019354, filed on Feb. 28, 2006, in the Korean Intellectual Property Office, the entire content of which is incorporated herein by reference.

BACKGROUND

1. Field of the Invention

The present invention relates to an organic light emitting display device and a driving method of the same. More particularly, the present invention relates to an organic light emitting display device and a driving method of the same for displaying an image of substantially uniform luminance.

2. Discussion of Related Art

Recently, various flat panel display devices capable of having a reduced weight and volume as compared to display devices with cathode ray tubes (CRT) have been developed. Among the flat panel display devices, the organic light emitting display devices make use of organic light emitting diodes that emit light by re-combination of electrons and holes.

However, there has been a problem in that the differences of the threshold voltages of the transistors included in the pixels of the organic light emitting display devices and deviations in electron mobility have prevented the display of an image with substantially uniform luminance.

SUMMARY OF THE INVENTION

In one embodiment of the present invention, a data driver of an organic light emitting display device having a plurality of feedback lines and a plurality of pixels, wherein each of the plurality of pixels coupled to a data line, is provided. The data driver includes a ramp pulse generating part for generating a ramp pulse to create a data signal in the data driver; and a current digital-to analog converting part for generating data currents using data received by the data driver. The data driver also includes a current control part for providing: the data signal to the data line of the organic light emitting display device; and comparing a pixel current generated in the plurality of pixels and output on a feedback line of the organic light emitting display device with the data current to control whether the data signal is further provided to the data line.

In one embodiment, the current control part includes a plurality of comparators, wherein each of the plurality of comparators is adapted to receive the pixel current generated in the plurality of pixels.

In some embodiments, the current control part includes a plurality of comparing parts. Each of the plurality of comparing parts includes a transistor coupled between the ramp pulse generating part and the data line. Each of the plurality of comparing parts also includes a comparator for comparing the pixel current with the data current; and a control part for controlling the transistor to be turned on or off corresponding to a comparison result of the comparator.

The control part allows the transistor to be turned on for a period while a reset signal is provided from a timing controller to the control part, wherein the first period is included in a horizontal period.

In some embodiments, the comparator provides a comparing signal when the data current and the pixel current are substantially different from each other, and ceases to provide the comparing signal when the data current is approximately equal to the pixel current.

In some embodiments, the control part allows the transistor to be turned off for a second period while the comparing signal ceases to be provided, wherein the second period is a period including a portion of the horizontal period that is not part of the first period. The data signal in the form of the ramp pulse is provided to the data line while the transistor is turned on, and ceases to be provided to the data line while the transistor is turned off.

In some embodiments, the ramp pulse has a voltage value that increases gradually, and in other embodiments, the ramp pulse has a voltage value that decreases gradually. In other embodiments, the data driver may also include a shift register part for generating a sampling signal; a sampling latch part for storing data provided to the sampling latch part in correspondence to the sampling signal; and a holding latch part for storing data stored in the sampling latch part. Further, in other embodiments, the data driver may also include a level shift part that is adapted to receive the data from the holding latch part and increase the voltage level of the received data.

In another embodiment of the present invention, an organic light emitting display device having a plurality of pixels coupled to data lines is provided. The device includes a plurality of pixels for receiving a data signal and outputting a pixel current to a feedback line of the organic light emitting display device; and a scan driver for providing: scanning signals to scan lines of the plurality of pixels and emission control signals to emission control lines of the plurality of pixels. The device also includes a data driver for: generating a data current in response to received data; applying the data signal to the data lines of the plurality of pixels; comparing the data current with the pixel current generated in the plurality of pixels to which the data signal is applied; and ceasing to apply the data signal to the data lines of the plurality of pixels when the pixel current is approximately equal to the data current.

In some embodiments, each of the plurality of pixels includes an organic light emitting diode; a first transistor for providing the data signal to a first node when the scanning signal is provided to the scan line; and a second transistor for providing the pixel current corresponding to a voltage value applied to the first node. In the embodiment, each of the plurality of pixels also includes a capacitor charged with a voltage corresponding to the voltage value applied to the first node; a third transistor for providing the pixel current to the feedback line when the scanning signal is provided to the scan line; and a fourth transistor that is turned on when the light emitting control signal is provided to the light emitting control line to provide the pixel current provided from the second transistor to the organic light emitting diode.

In some embodiments, the data driver of the device includes a ramp pulse generating part for generating a ramp pulse to create the data signal; and a current digital-to analog converting part for generating data currents using data received by the data driver. The data driver also includes a current control part for: providing the data signal to the data line; and comparing the pixel current provided from the feedback line with the data current to control whether the data signal is further provided to the data line.

In some embodiments, the current control part includes a plurality of comparators, wherein each of the plurality of comparators is adapted to receive the pixel current generated in the plurality of pixels.

In some embodiments, the current control part includes a plurality of comparing parts wherein each of the plurality of comparing parts includes a tenth transistor which is coupled between the ramp pulse generating part and at least one of the data lines; and a comparator for comparing the pixel current with the data current. Each of the plurality of comparing parts may also include a control part for controlling the tenth transistor to be turned either on or off corresponding to a comparison result of the comparator.

In some embodiments, the control part controls the tenth transistor to be turned on for a first period when the control part receives a reset signal from a timing controller, wherein the first period is one part of a horizontal period.

In some embodiments, the comparator provides a comparing signal when the data current and the pixel current are substantially different from each other and ceases to provide the comparing signal when the data current is approximately equal to the pixel current. The control part controls the tenth transistor to be turned off when the providing of the comparing signal is ceased during a second period, wherein the second period including a portion of the horizontal period that is not part of the first period.

In some embodiments, the ramp pulse is provided to the data line while the tenth transistor is turned on the ramp pulse ceasing to be provided when the tenth transistor is turned off. In those embodiments, the capacitor is charged with a voltage corresponding to a voltage value of the ramp pulse when the tenth transistor is turned off. In some of these embodiments, the ramp pulse has a gradually increasing voltage value, and in other embodiments, the ramp pulse has a gradually decreasing voltage value. The data driver may also include a shift register part for generating a sampling signal; a sampling latch part for storing data provided from a timing controller corresponding to the sampling signal; and a holding latch part for temporarily storing data stored in the sampling latch part.

In another embodiment of the present invention, a method of driving an organic light emitting display device having a plurality of pixels and a data driver is provided. The method includes: applying a scanning signal to selected pixels of the plurality of pixels; applying a data signal to the selected pixels; and generating in the data driver data current corresponding to a data received by the data driver. The method also includes comparing the data current in the data driver with a pixel current generated in the selected pixels to which the data signal is applied; and ceasing to apply the data signal to the selected pixels when the pixel current is approximately equal to the data current.

In some embodiments, the data signal is a ramp pulse having a voltage value that gradually increases. In other embodiments, the data signal is a ramp pulse having a voltage value that gradually decreases.

DETAILED DESCRIPTION

Figure 1:
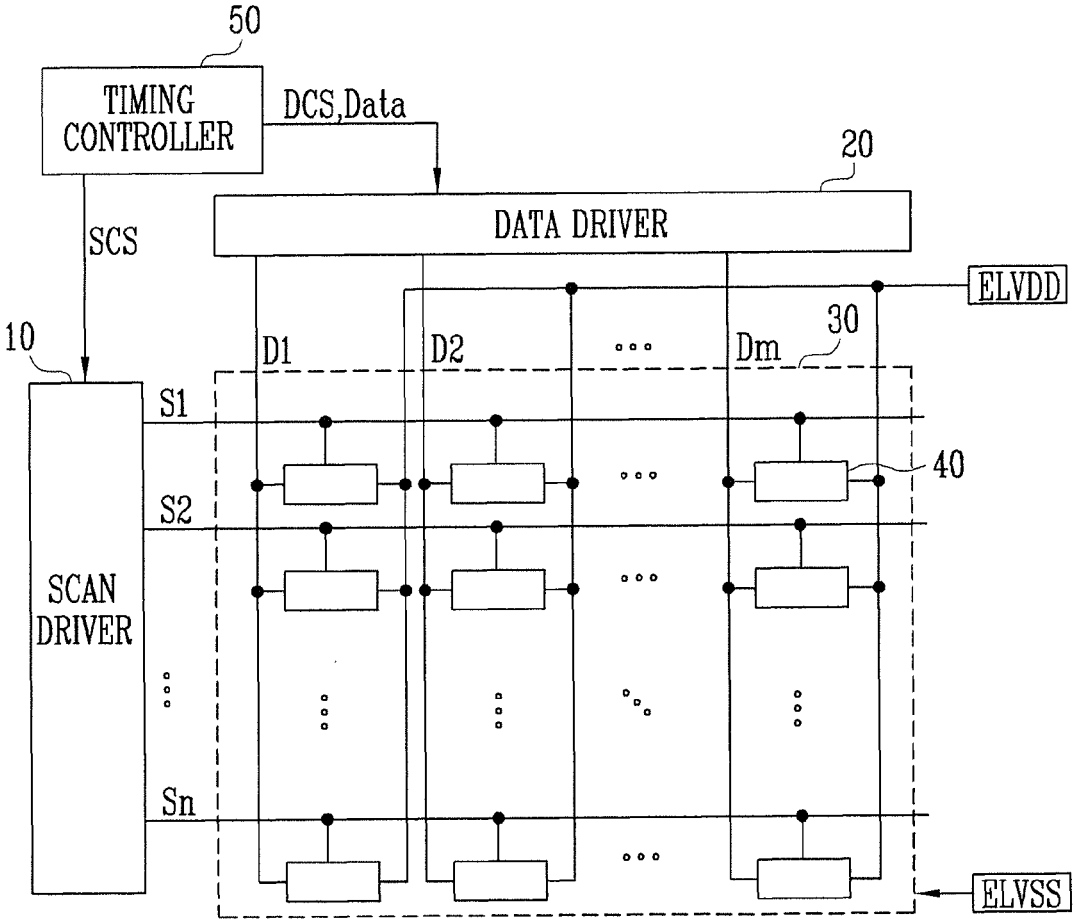
FIG. 1 (Related Art)
FIG. 1 is a block diagram showing a conventional organic light emitting display device.

FIG. 1 is a block diagram showing a conventional organic light emitting display device. The device includes a pixel portion 30, a scan driver 10, a data driver 20, and a timing controller 50. The pixel portion 30 includes a plurality of pixels 40 formed at a crossing area of scan lines S1 to Sn, emission control lines E1 to En (not shown), and data lines D1 to Dm. The scan driver 10 provides scan signals along scan lines S1 to Sn. The data driver 20 provides data signals along data lines D1 to Dm. The timing controller 50 controls the scan driver 10 and the data driver 20.

The timing controller 50 generates a data drive control signal DCS and a scan drive control signal SCS according to externally supplied synchronous signals. The data drive control signal DCS generated by the timing controller 50 is provided to the data driver 20, and the scan drive control signal SCS is provided to the scan driver 10. Furthermore, the timing controller 50 provides externally supplied data Data to the data driver 20.

The scan driver 10 generates a scan signal in response to the scan drive control signal SCS from the timing controller 50, and sequentially provides the generated scan signal to the scan lines S1 to Sn. The scan driver 10 generates an emission control signal in response to the scan drive control signal SCS from the timing controller 50, and sequentially provides the generated emission control signal to the emission control lines E1 to En.

The data driver 20 receives the data drive control signal DCS from the timing controller 50. Upon the receipt of the data drive control signal DCS, the data driver 20 generates data signals, and provides the generated data signals to the data lines D1 to Dm. In one embodiment, the data driver 20 provides the generated data signals to the data lines D1 to Dm every 1 horizontal period.

The pixel portion 30 receives a first voltage (ELVDD) from a first power supply and a second voltage (ELVSS) from a second power supply, both the first power supply and the second power supply being located at an exterior location relative to the pixel portion, and provides them to pixels 40. Upon the receipt of the ELVDD and the ELVSS, the pixels 40 control an amount of a current into the second power supply through a light emitting element corresponding to the data signal, thus generating light corresponding to the data signal.

Figure 2:
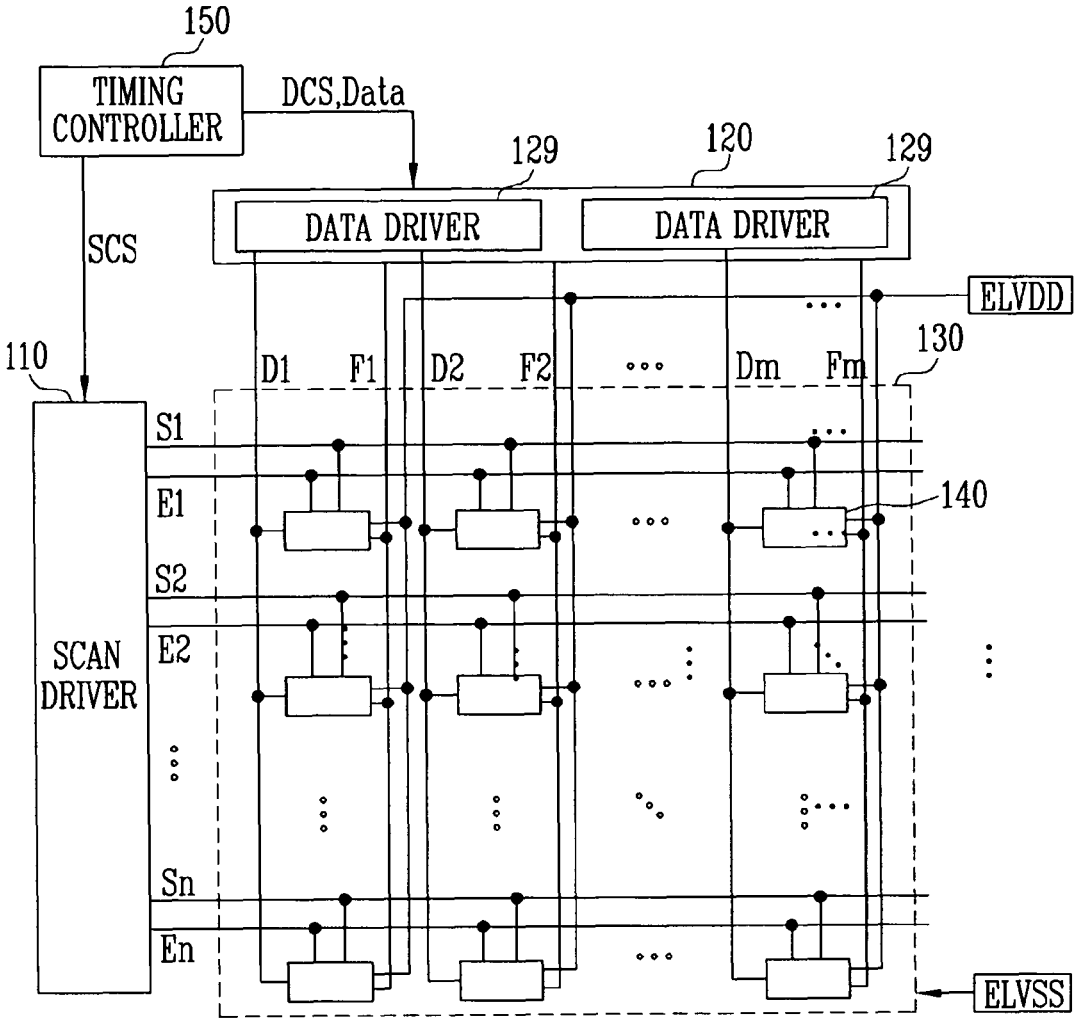
FIG. 2 is a block diagram showing an organic light emitting display device according to an embodiment of the present invention.

FIG. 2 is a block diagram showing an organic light emitting display device according to an embodiment of the present invention. The organic light emitting display device according to an embodiment of the present invention includes a pixel portion 130, a scan driver 110, a data driver 120 and a timing controller 150. The pixel portion 130 includes pixels 140 formed in areas divided by scan lines S1 through Sn, light emitting control lines E1 through En, data lines D1 through Dm and feedback lines F1 through Fm. The scan driver 110 is for driving scan lines S1 through Sn and light emitting control lines E1 through En. The data driver 120 is for driving data lines D1 through Dm and feedback lines F1 through Fm. The timing controller 150 is for controlling the scan driver 110 and the data driver 120.

The pixel portion 130 includes pixels 140 connected with the scan lines S1 through Sn, light emitting control lines E1 through En, data lines D1 through Dm and feedback lines F1 through Fm. In one embodiment, the scan lines S1 through Sn are formed in a horizontal direction and provide scanning signals to the pixels 140; the light emitting control lines E1 through En are formed in the horizontal direction and provide light emitting control signals to the pixels 140; and the data lines D1 through Dm are formed in a vertical direction and provide data signals having a type of ramp pulse. In the embodiment, the data signals, which are provided to the data lines D1 through Dm, have a voltage that gradually increases or decreases according to a ramp pulse. In the same embodiment, the feedback lines F1 through Fm are formed in the vertical direction and provide currents from the pixels 140 to the data driver 120.

The pixels 140 receive the first voltage (ELVDD) from the first power supply and the second voltage (ELVSS) from the second power supply, both the first power supply and the second power supply being at an exterior location relative to the pixels 140. The pixels 140 to which the ELVDD and the ELVSS are provided control pixel currents flowing through organic light emitting diodes from the first power supply to the second electrical power supply corresponding to the data signals provided from the data lines D1, D2, . . . , Dm. Since the data signals are provided in the form of ramp pulse, as time elapses, the pixel currents are gradually increased (or decreased). And, the pixels 140 provide the pixel currents to the feedback lines F when the data signals are provided to the data lines D1, D2, . . . , Dm.

The timing controller 150 generates a data driving control signal DCS and a scan driving control signal SCS corresponding to a synchronizing signal from an exterior location. The data driving control signal DCS is provided to the data driver 120 and the scan driving control signal SCS is provided to the scan driver 110. The timing controller 150 provides data from an exterior location to the data driver 120.

The scan driver 110 receives the scan driving control signal SCS from the timing controller 150. The scan driver 110, which receives the scan driving control signal SCS, generates a scanning signal and provides the scanning signal to the scan lines S1, S2, . . . , Sn.

The data driver 120 receives the data driving control signal DCS from the timing controller 150. The data driver 120 also receives a data signal of the type of ramp pulse to the data lines D1 through Dm to be synchronized with the scanning signal. The data driver 120 also receives the pixel currents from each of pixels 140 through the feedback lines F1 through Fm. The data driver 120 determines whether the pixel current corresponds to the data current in the data driver. For example, when a data current is 10 μA, the data driver 120 determines whether the pixel current which flows through each pixel 140 is approximately 10 μA. When desirable currents flow through each pixel 140, the data driver 120 ceases to provide the data signal. The data driver 120 includes at least one data driving circuit 129 having j, wherein j is a positive integer. FIG. 2 shows an embodiment of a data driver 120 with two data driving circuits 129.

Figure 3:
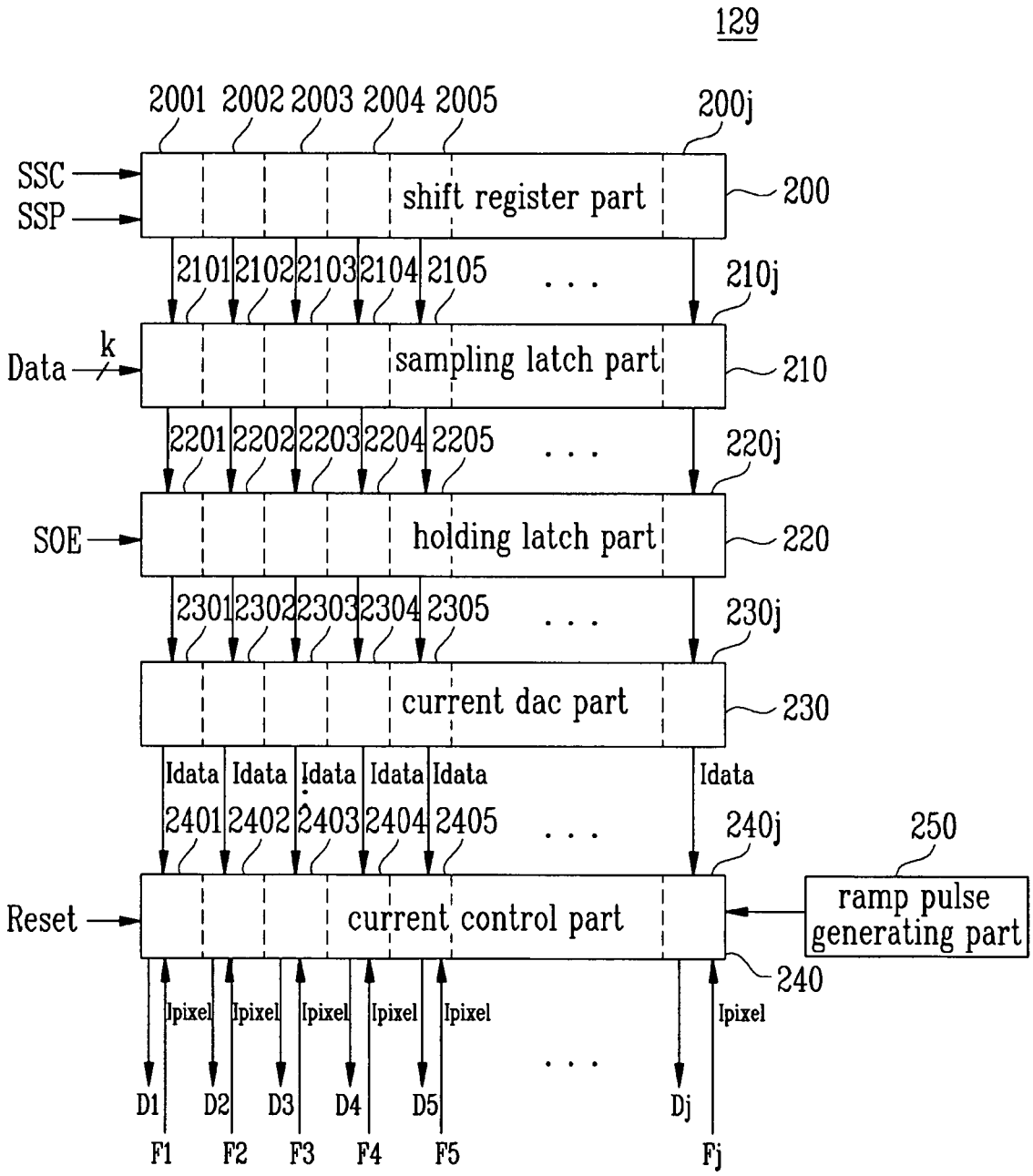
FIG. 3 is a block diagram showing the first embodiment of the data driving circuit depicted in FIG. 2.

FIG. 3 is a block diagram of an embodiment of the data driving circuit 129 depicted in FIG. 2. The data driving circuit 129 includes a shift register part 200 for generating a sampling signal, a sampling latch part 210 for storing data in response to the sampling signal, a holding latch part 220 for temporarily storing data in the sampling latch part 210 and providing the stored data to a current Digital-to-Analog Converter (DAC) part 230, the current DAC part 230 for generating data currents Idata corresponding to bit values of data Data, a current control part 240 for comparing pixel currents Ipixel with the data currents Idata and controlling the supply of the data signal in accordance with the comparison result, and a ramp pulse generating part 250 for providing a ramp pulse.

The shift register part 200 receives a source shift clock SSC and a source start pulse SSP from the timing controller 150. The shift register part 200 shifts the source start pulse SSP every period of the source shift clock SSC and progressively generates j sampling signal(s). For doing this, the shift register part 200 has j shift register(s) 2001 through **200*j***.

The sampling latch part 210 progressively stores data Data in response to the sampling signals provided from the shift register part 200. The sampling latch part 210 has j sampling latch(s) 2101 through **210*j* for storing j data. And, each sampling latch 2101 through 210*j* has a size corresponding to bits of the data Data. For example, if the data Data includes k bits, the sampling latches 2101 through 210*j*** are set to k-bit size.

The holding latch part 220 stores the data Data input from the sampling latch part 210 when a source outputting enable (SOE) signal is input into the holding latch part 220. The holding latch part 220 provides the stored data Data to the current DAC part 230 when the SOE signal is input into the holding latch 220. For doing this, the holding latch part 220 has j holding latch(s) 2201 through **220*j***, each of which is set to k-bit size.

The current DAC part 230 generates a data current Idata corresponding to the bit value of data (that is, the gradation value) and provides the data current Idata to the current control part 240. The term "data current" Idata as used herein means "a current that flows through the pixel 140 (not shown) as the data current Idata corresponds to the bit value of the data Data." The term "pixel currents" Ipixel as used herein means "currents flowing through the pixels 140 after pixels 140 receive the data signal." The pixel current Ipixel provided to the organic light emitting diode should be approximately equal to the data current Idata to display an image having a desirable luminance. The current DAC part 230 generates j data currents 2301 through **230*j* corresponding to j data provided from the holding latch part 220. For doing this, the current DAC part 230 includes j current DACs 2301 through 230*j***.

The ramp pulse generating part 250 provides comparing parts 2401 through **240*j* included in the current control part 240 with the ramp pulse, which is increased or decreased over time. The ramp pulse is provided via the comparing part 2401 through 240*j*** to data lines D1 through Dj as a data signal.

The current control part 240 provides the data lines D1 through Dj with the data signal as a ramp pulse provided from the ramp pulse generating part 250. The current control part 240 receives the pixel current Ipixel, which corresponds to the data signal. The pixel current Ipixel is received from the pixel 140 (not shown). The current control part 240 compares the pixel current Ipixel with the data current Idata, and ceases to provide the data signal D1 through Dj when the pixel current Ipixel is approximately equal to the data current Idata. For doing this, the current control part 240 includes j comparing parts 2401 through 240j. Also, the current control part 240 is provided with a reset signal Reset for one period of each horizontal period.

Figure 4:
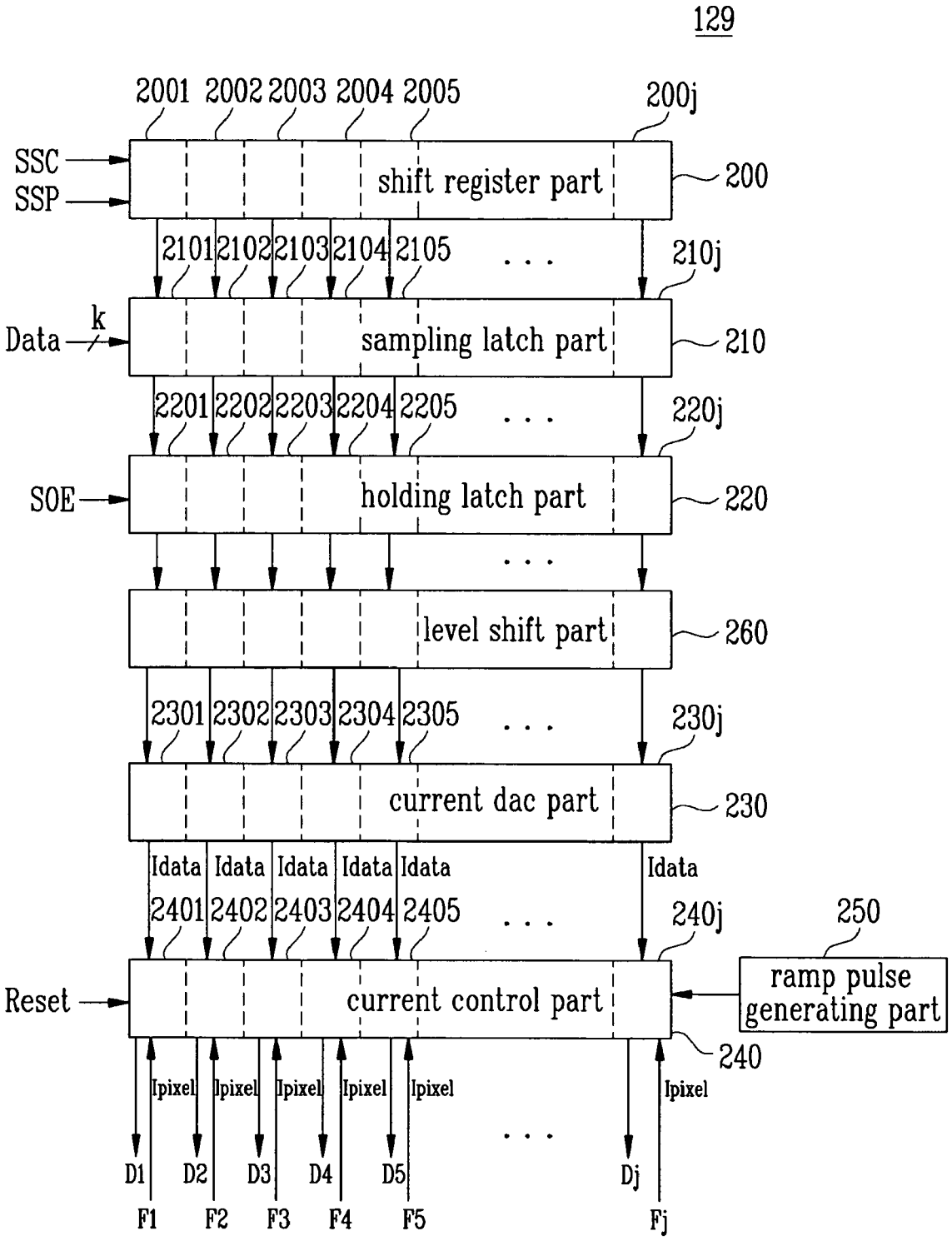
FIG. 4 is a block diagram showing the second embodiment of the data driving circuit depicted in FIG. 2.

FIG. 4 is a block diagram showing the second embodiment of the data driving circuit depicted in FIG. 2. As compared with FIG. 3, the data driving circuit 129 further includes a level shift part 260 placed between the holding latch part 220 and the current DAC part 230. The level shift part 260 causes the voltage level of data Data provided from the holding latch part 230 to be increased and provides it to the current DAC part 230. If data Data having a high level voltage is input from an external system to the data driving circuit 129, manufacturing costs may be increased because circuit parts corresponding to that voltage level must be installed. Therefore, data Data having a low voltage level is provided from the external system to the data driving circuit, and the level of data Data may be raised to a high voltage level in the level shift part 260.

Figure 5:
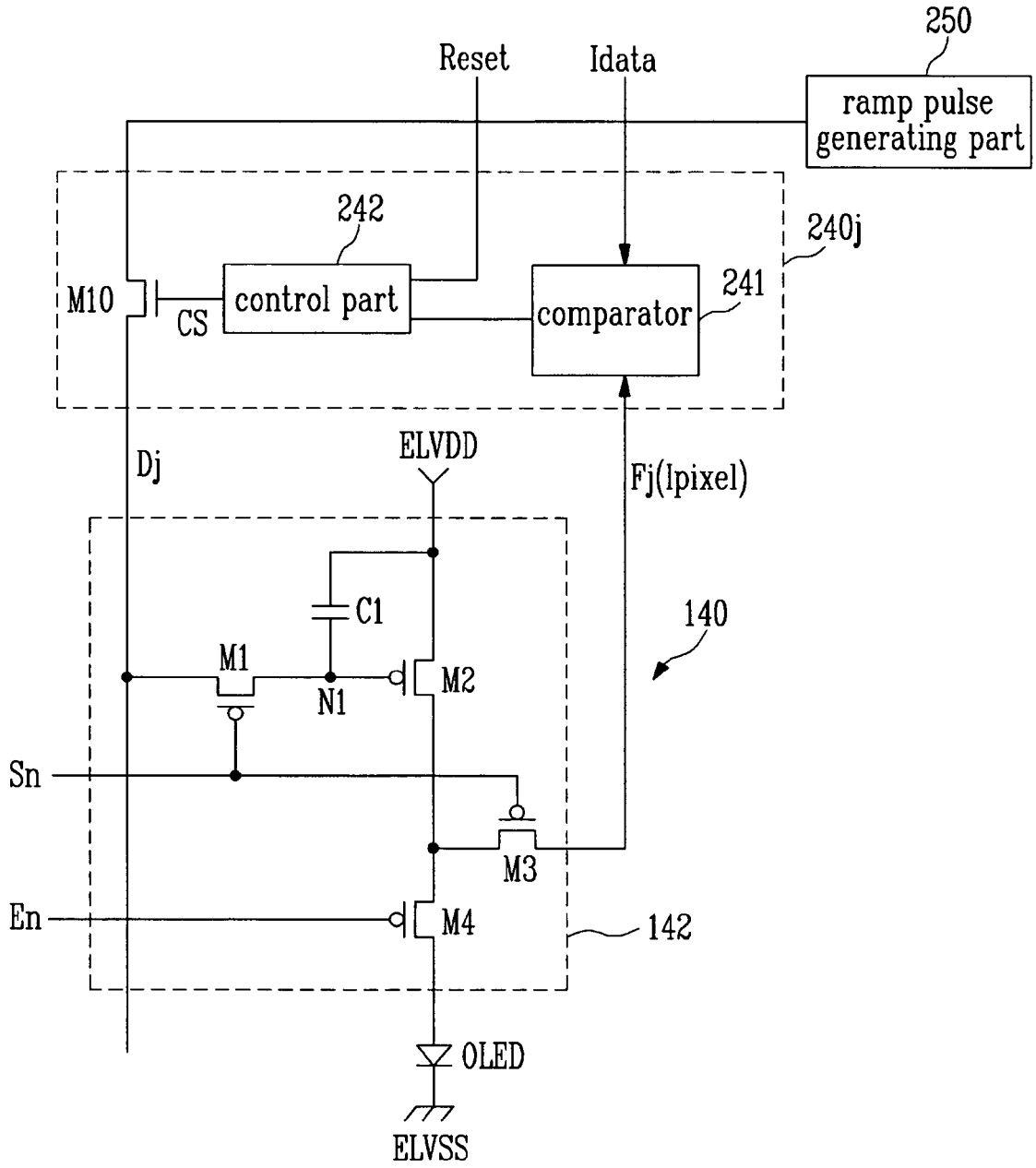
FIG. 5 is a block diagram showing embodiments of the comparing part and the pixel depicted in FIG. 3.

FIG. 5 is a block diagram of embodiments of structures of a comparing part and a pixel depicted in FIG. 3. For convenience of description, only comparing 240; and one pixel are shown. The comparing part 240j and the pixel 140 are coupled together by the j-th data line Dj and the jth feedback line Fj. The pixel 140 includes an organic light emitting diode (OLED) and a pixel circuit 142 for controlling a current provided to the OLED.

The OLED generates a light of a predetermined luminance corresponding to an amount of current provided from the pixel circuit 142. For doing this, the pixel circuit 142 includes a first transistor M1, a second transistor M2, a third transistor M3 and a fourth transistor M4 and a capacitor C1. In one embodiment, the OLED generates a red light, a green light or a blue light corresponding to the amount of current provided from the pixel circuit 142.

The first electrode of the first transistor M1 is coupled to the data line Dj and the second electrode of M1 is coupled to a first node N1. The gate of the first transistor M1 is coupled to the scan line Sn. The first transistor M1 is turned on to provide the data signal provided from the data line Dj to the first node N1 when the scanning signal is provided to M1. One of the source and the drain is set as the first electrode, and the other is set as the second electrode. For example, if the source is set as the first electrode, the second electrode is the drain.

The first electrode of the second transistor M2 is coupled to the first power source (ELVDD), and the second electrode of M2 is coupled to the first electrode of the fourth transistor M4. The gate of the second transistor M2 is coupled to the first node N1. The second transistor M2 provides a predetermined current to the fourth transistor M4 corresponding to a voltage charged in the capacitor C1.

The first electrode of the third transistor M3 is coupled to the second electrode of the second transistor M2, and the second electrode of M3 is coupled to feedback line Fj. The gate of the third transistor M3 is coupled to the scan line Sn. When a scanning signal is provided to the third transistor M3, the third transistor M3 is turned on to provide the pixel current from the second transistor M2 to the feedback line Fj.

The first electrode of the fourth transistor M4 is coupled to the second electrode of the second transistor M2. The gate of the fourth transistor M4 is coupled to a light emitting control line En. The fourth transistor M4 is turned off in a case that the light emitting control signal is provided to the light emitting control line En, and in the other cases, the transistor M4 is turned on to allow the second electrode of the second transistor M2 and the OLED to be in electrical connection with each other. Therefore, when the fourth transistor M4 is turned on, the pixel current is provided from the second transistor M2 to the OLED. This operation of the pixel 140 is described in detail later on.

The comparing part 240*j* includes a comparator 241, a control part 242 and a tenth transistor M10. The comparator 241 compares the pixel current Ipixel from the feedback line Fj with the data current Idata from the current DAC part 230 (not shown). The comparator 241 generates a comparison signal and provides it to the control part 242 when a current value of the pixel current Ipixel is substantially different from that of the data current Idata. And, the comparator 241 ceases to provide the comparison signal to the control part 242 when the current value of the pixel current Ipixel is approximately equal to that of the data current Idata.

In one embodiment, either the reset signal or the comparison signal is provided to the control part 242. The control part 242 provides a control signal CS to the tenth transistor M10 to turn the tenth transistor M10 on. In other embodiments, the control part 242 causes the tenth transistor M10 to be turned off. For doing this, the control part 242 may be implemented with a logic gate. In one embodiment, the control part 242 is implemented by combining at least one or more of an OR gate, an AND gate, a NAND gate or a NOR gate.

When the tenth transistor M10 is turned on, the ramp pulse from the ramp pulse generating part 250 is provided to the data line Dj as the data signal. When the tenth transistor M10 is turned off, the data signal is not provided.

Figure 6A:
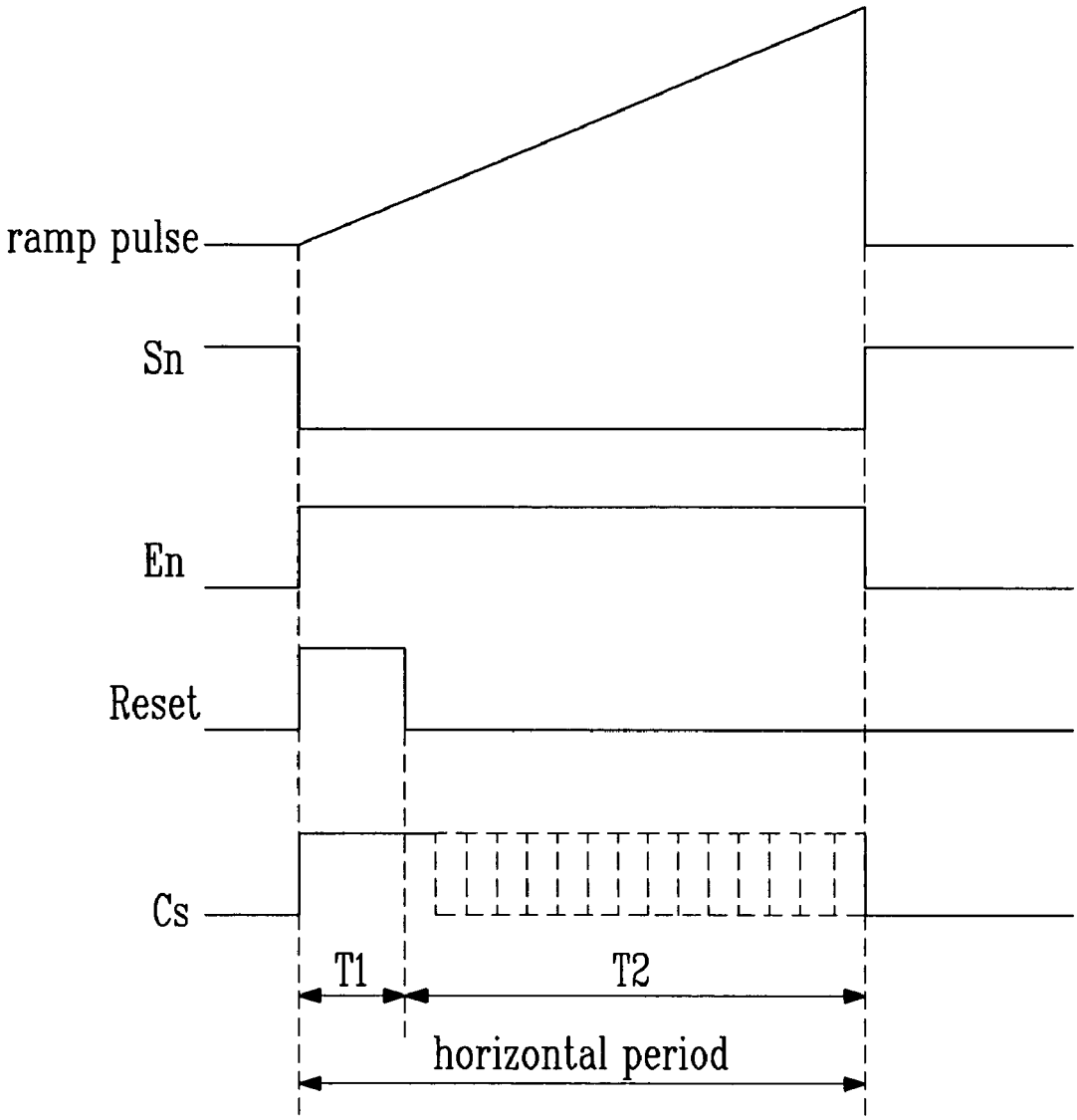
FIGS. 6*a* and 6*b* are illustrations of waveforms illustrating an operation of the comparing part and the pixel depicted in FIG. 5 according to a first embodiment.

FIG. 6*a* is an illustration of a driving waveform provided to the comparing part and the pixel depicted in FIG. 5. Describing the operation in connection with FIG. 5 and FIG. 6*a*, the scanning signal is provided to the scan line Sn during a particular horizontal period, and during the same horizontal period, the light emitting control signal is provided to the light emitting control line En. When the light emitting control signal is provided to the light emitting control line En, the fourth transistor M4 is turned on. When the scanning signal is provided to the scan line Sn, the first transistor M1 and third transistor M3 are turned on.

The reset signal Reset is provided to the control part 242 for the first period T1 of the horizontal period. Then, for the first period T1, the control signal CS is provided to the tenth transistor M10 to be turned on. If the tenth transistor M10 is turned on, the ramp pulse, which is provided from the ramp pulse generating part 250, is provided to the data line Dj.

The ramp pulse provided to the data line Dj is provided via the first transistor M1 to the first node N1. At this time, the capacitor C1 is charged with a voltage being progressively increased corresponding to the ramp pulse provided to the first node N1. The second transistor M2 provides the predetermined pixel current Ipixel that corresponds to the voltage of the ramp pulse applied to the first node N1 through the third transistor M3 to the feedback line Fj.

The comparator 241 compares the pixel current Ipixel with the data current Idata. If the value of the pixel current Ipixel is not approximately equal to that of the data current Idata, the comparator 241 provides the comparison signal to the control part 242. The control part 242, upon receiving the comparison signal, provides the control signal CS to the tenth transistor M10 to remain at the turned-on state.

Figure 6B:
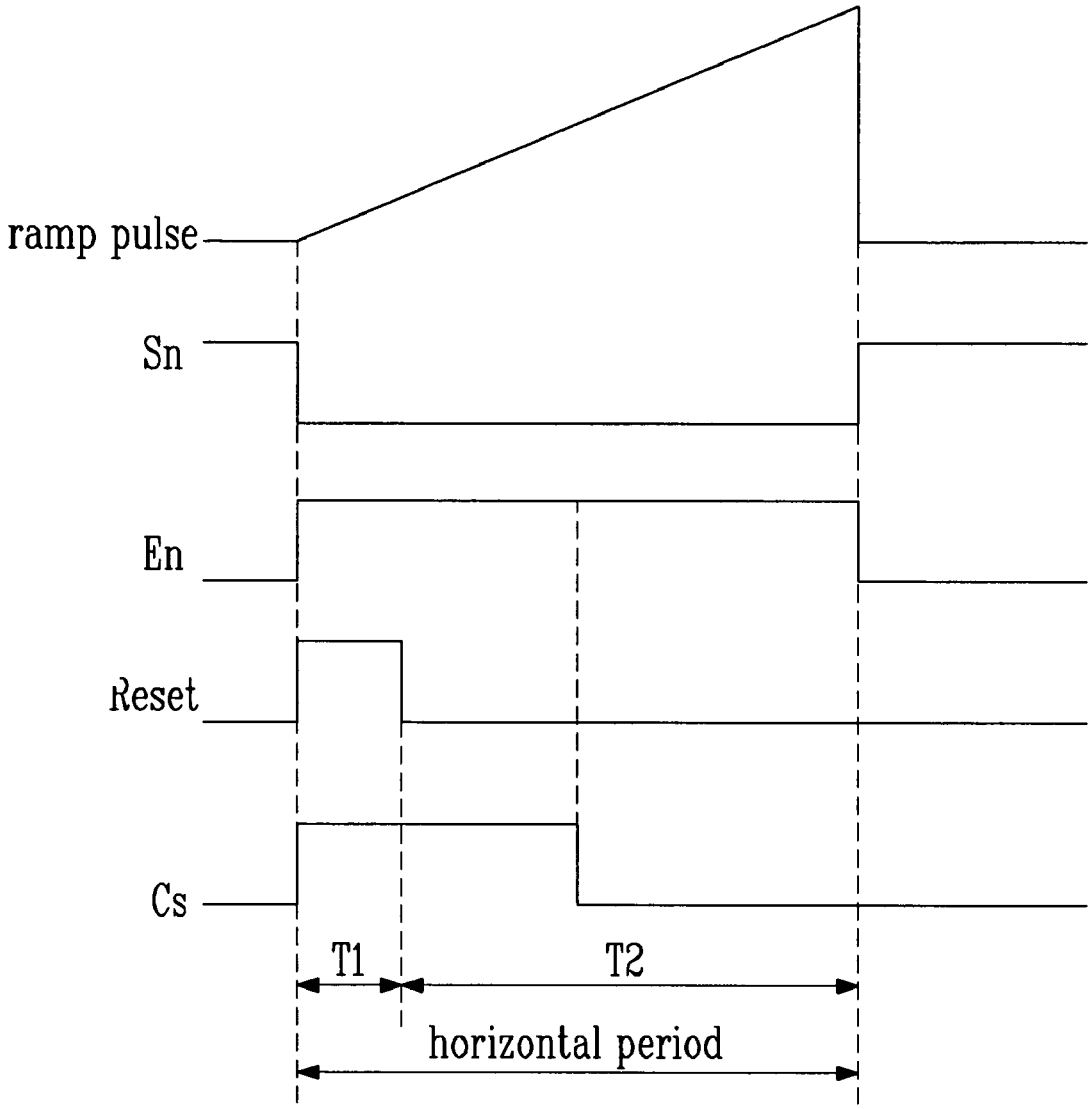

When the comparator 241 determines that the value of the pixel current Ipixel is, upon receiving the comparison signal, equal to that of the data current Idata, the comparator 241 ceases to provide the comparison signal. Then, the control part 242 causes the tenth transistor M10 to be turned off at the time that the comparison signal is provided to the control part 242. In other words, at the time that the value of the pixel current Ipixel is approximately equal to that of the data current Idata, the control part 242 ceases to provide the control signal CS to the tenth transistor M10 to allow the tenth transistor M10 to be turned off. For example, in connection with FIG. 6*b*, at a particular time point during the second period T2, the control part 242 ceases to provide the control signal CS.

When the tenth transistor M10 is turned off, the supply of the ramp pulse is stopped. The capacitor C1 of the pixel 140 is charged with the voltage corresponding to the ramp pulse provided before the tenth transistor M10 is turned off.

The supply of the scanning signal is ceased after the particular horizontal period. Accordingly, the first transistor M1 and the third transistor M3 are turned off. The fourth transistor M4 is turned on after the horizontal period. If the fourth transistor M4 is turned on, the pixel current corresponding to the charged voltage in the capacitor C1 is provided to the OLED such that a light of a predetermined luminance is generated from the OLED.

As described above, according to the present invention, the pixel current flowing through the pixel is fed back to the comparing part 240j and by comparing the feedback current with the data current, the value of the voltage charged in the pixel may be controlled. When the value of the voltage charged in the pixel is controlled by feeding back the pixel current flowing through the pixel 140, an image of uniform luminance can be displayed without regard to threshold voltages of transistors M1, M2, M3, M4 included in the pixel 140 and any deviation of electron mobility. In conventional organic light emitting display devices, the data signal is generated from channels different from one another such that it is difficult to display an image with a uniform luminance.

Figure 7:
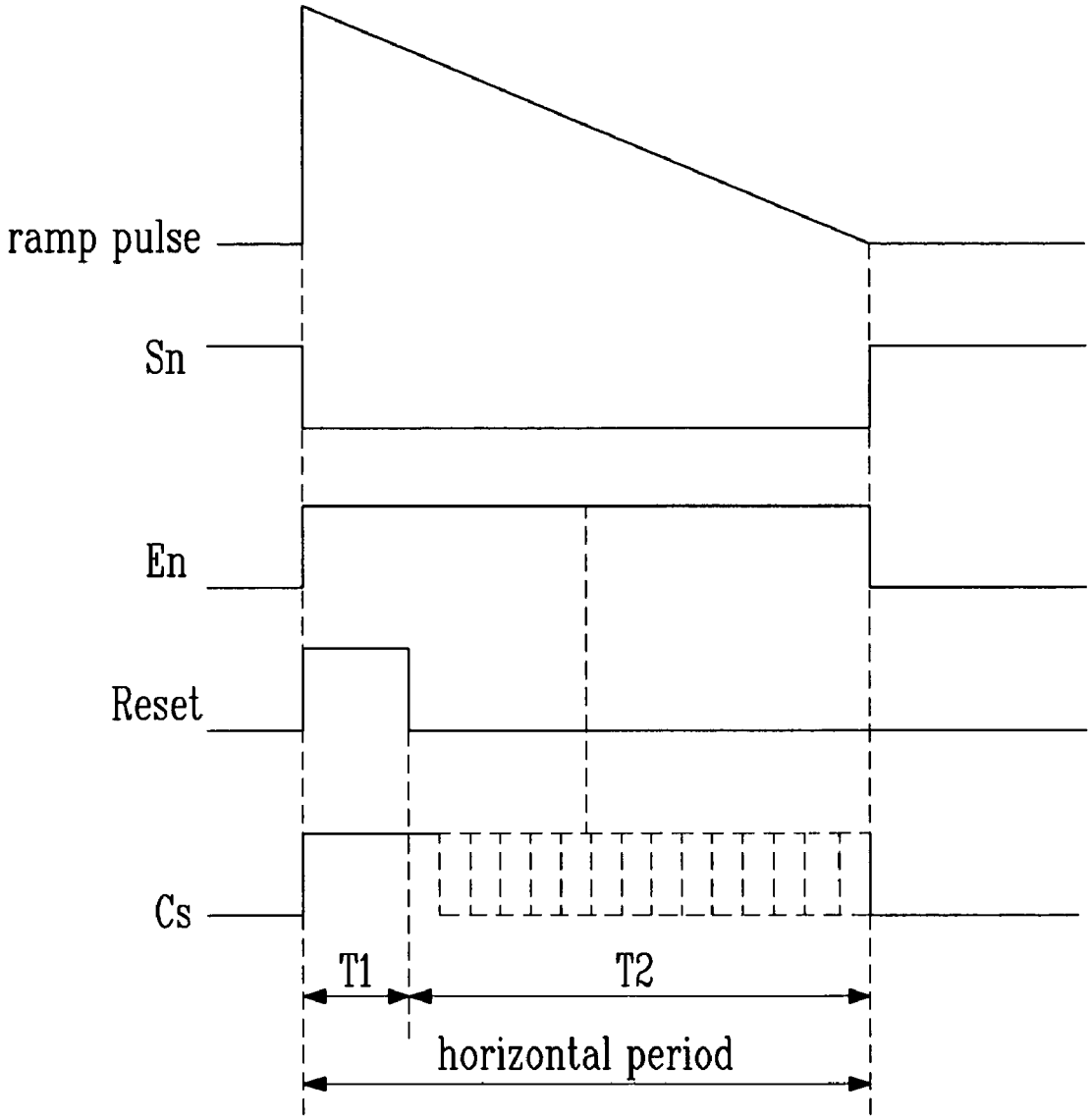
FIG. 7 is an illustration of views of a waveform illustrating an operation of the comparing part and the pixel depicted in FIG. 5 according to a second embodiment.

The ramp pulse provided from the ramp pulse generating part 250 may be set to various types of ramps. In one embodiment, the ramp pulse generating part 250, as shown in FIG. 7, generates a ramp pulse having a gradually decreasing voltage value. Though the ramp pulse having a gradually decreasing voltage value is provided to the data line Dj, the pixels 140 can stably display a uniform image.

As described above, the organic light emitting display device and the driving method for the same according to embodiments of the present invention is provided. A ramp pulse is provided as a data signal and a pixel current corresponding to the provided ramp pulse is feedback from the pixel. After this, the feedback pixel current and the data current are compared with each other, and when it is determined that two current values are approximately equal to each other, the supply of the data signal is ceased. That is, by stopping the supply of the data signal when a desirable pixel current flows through the pixel, the device may be able to uniformly display an image of a desirable luminance without regard to threshold voltages of transistors in the pixel, the deviation of electron mobility, etc. Since the ramp pulse generated from one ramp pulse generating part is provided to all data lines, a uniform image may be displayed without a substantial voltage deviation.

Although exemplary embodiments of the present invention have been shown and described, it would be appreciated by those skilled in the art that changes might be made in these embodiment without departing from the principles and spirit of the invention, the scope of which is defined in the claims and their equivalents.

What is claimed is:

1. A data driver of an organic light emitting display device, the device having a plurality of pixels, each of the plurality of pixels being coupled to a data line, the data driver comprising:

a ramp pulse generating part for generating a ramp pulse to create a data signal in the data driver;

a current digital-to-analog converting part for generating data currents using data received by the data driver;

a current control part for:

providing the data signal to the data line of the organic light emitting display device; and comparing a pixel current generated in the plurality of pixels and output on a feedback line of the organic light emitting display device with a data current of the data currents to control whether the data signal is further provided to the data line, wherein the current control part comprises a plurality of comparing parts, each of the comparing parts comprising:

a transistor coupled between the ramp pulse generating part and the data line:

a comparator for receiving the pixel current and comparing the pixel current with the data current; and a control part for controlling the transistor to be turned on or off in accordance with a comparison result of the comparator, wherein the control part is configured to provide a binary signal to control the transistor to be turned on for a first period while a reset signal is provided from a timing controller to the control part.

2. The data driver as claimed in claim 1, wherein the comparator provides a comparing signal when the data current and the pixel current are substantially different from each other, and ceases to provide the comparing signal when the data current is approximately equal to the pixel current.

3. The data driver as claimed in claim 2, wherein the control part allows the transistor to be turned off for a second period while the comparing signal ceases to be provided, the second period including a portion of the horizontal period not part of the first period.

4. The data driver as claimed in claim 3, wherein the data signal in the form of the ramp pulse is provided to the data line while the transistor is turned on, and ceases to be provided to the data line while the transistor is turned off.

5. The data driver as claimed in claim 1, wherein the ramp pulse has a gradually increasing voltage value.

6. The data driver as claimed in claim 1, wherein the ramp pulse has a gradually decreasing voltage value.

7. The data driver as claimed in claim 1, further comprising:

a shift register part for generating a sampling signal;

a sampling latch part for storing data provided to the sampling latch part in correspondence to the sampling signal; and a holding latch part for storing data stored in the sampling latch part.

8. The data driver as claimed in claim 7, further comprising a level shift part that is adapted to:

receive the data stored in the holding latch part; and increase a voltage level of received data.

9. An organic light emitting display device comprising:

a plurality of pixels for receiving a data signal and outputting a pixel current to a feedback line of the organic light emitting display device;

a scan driver for providing:

scanning signals to scan lines of the plurality of pixels; and emission control signals to emission control lines of the plurality of pixels; and a data driver for:

generating a data current in response to received data;

applying the data signal to the data lines of the plurality of pixels;

comparing the data current with the pixel current generated in the plurality of pixels to which the data signal is applied; and ceasing to apply the data signal to the data lines of the plurality of pixels when the pixel current is approximately equal to the data current, the data driver comprising:

a ramp pulse generating part for generating a ramp pulse to create the data signal;

a current digital-to-analog converting part for generating data currents using data received by the data driver; and a current control part for:

providing the data signal to the data line; and comparing the pixel current provided from the feedback line with the data current to control whether the data signal is further provided to the data line, the current control part comprising a plurality of comparing parts, each of the comparing parts comprising:

a tenth transistor coupled between the ramp pulse generating and at least one of the data lines;

a comparator for receiving the pixel current and for comparing the pixel current with the data current; and a control part for controlling the tenth transistor to be turned either on or off corresponding to a comparison result of the comparator, wherein the control part is configured to provide a binary signal to control the tenth transistor to be turned on for a first period while a reset signal is provided from a timing controller to the control part.

10. The organic light emitting display device as claimed in claim 9, wherein each of the plurality of pixels includes:

an organic light emitting diode;

a first transistor for providing the data signal to a first node when a scanning signal of the scanning signals is provided to the scan line;

a second transistor for providing the pixel current corresponding to a voltage value applied to the first node;

a capacitor charged with a voltage corresponding to the voltage value applied to the first node;

a third transistor for providing the pixel current to the feedback line when at least one of the scanning signals is provided to at least one of the scan lines; and a fourth transistor that is turned on when at least one of the emission control signals is provided to at least one of the emission control lines to provide the pixel current provided from the second transistor to the data driver.

11. The organic light emitting display device as claimed in claim 10, wherein the capacitor is charged with a voltage corresponding to a voltage value of the ramp pulse when the tenth transistor is turned off.

12. The organic light emitting display device as claimed in claim 9, wherein the comparator provides a comparing signal when the data current and the pixel current are substantially different from each other and ceases to provide the comparing signal when the data current is approximately equal to the pixel current.

13. The organic light emitting display device as claimed in claim 12, wherein the control part controls the tenth transistor to be turned off when the providing of the comparing signal is ceased during a second period, wherein the second period includes a portion of the horizontal period not part of the first period.

14. The organic light emitting display device as claimed in claim 13, wherein the ramp pulse is provided to the data line while the tenth transistor is turned on and the ramp pulse ceases to be provided to the data line when the tenth transistor is turned off.

15. The organic light emitting display device as claimed in claim 9, wherein the ramp pulse has a gradually increasing voltage value.

16. The organic light emitting display device as claimed in claim 9, wherein the ramp pulse has a gradually decreasing voltage value.

17. The organic light emitting display device as claimed in claim 9, wherein the data driver further comprises:

a shift register part for generating a sampling signal;

a sampling latch part for storing data, wherein the data corresponds to the sampling signal; and a holding latch part for temporarily storing data stored in the sampling latch part.

18. A method of driving an organic light emitting display device having a plurality of pixels and a data driver, the method comprising:

applying a scanning signal to selected pixels of the plurality of pixels;

generating a ramp pulse to create a data signal for applying to the selected pixels;

generating in the data driver a data current corresponding to data received by the data driver;

receiving the data signal and outputting a pixel current to a feedback line of the organic light emitting device;

comparing the data current in the data driver with the pixel current generated in the selected pixels to which the data signal is applied;

generating a binary signal to control a transistor in accordance with the comparing the data current to the pixel current;

ceasing to apply the data signal to the selected pixels by turning off the transistor when the pixel current is approximately equal to the data current, in accordance with the binary signal; and providing, during a first period, the binary signal to turn on the transistor while a reset signal is provided.

19. The organic light emitting display device as claimed in claim 18, wherein the data signal is a ramp pulse having a gradually increasing voltage value.

20. The organic light emitting display device as claimed in claim 18, wherein the data signal is a ramp pulse having a gradually decreasing voltage value.

* * * * *

UNITED STATES PATENT AND TRADEMARK OFFICE

CERTIFICATE OF CORRECTION

PATENT NO. : 7,834,826 B2
APPLICATION NO. : 11/601180
DATED : November 16, 2010
INVENTOR(S) : Oh Kyong Kwon It is certified that error appears in the above-identified patent and that said Letters Patent is hereby corrected as shown below:

On the Title Page

| | |
|---|---|
| (56) **References Cited** OTHER PUBLICATIONS, line 2 | Delete "Sep. 3, 2008." Insert -- Sep. 3, 2008, indicating the relevance of the cited reference in this IDS. -- |
| (56) **References Cited** OTHER PUBLICATIONS page 2, Col. 2, line 2 | After "text" Insert --, indicating relevance of above CN reference. -- |
| page 2, Col. 2, line 4 | After "2006-192865," Insert -- noting listed references in this IDS, as well as -- |

In the Claims

| | |
|---|---|
| Column 10, Claim 1, line 5 | Delete "line:" Insert -- line; -- |
| Column 11, Claim 9, line 12 | After "generating" Insert -- part -- |

Signed and Sealed this
Twenty-seventh Day of December, 2011

David J. Kappos

David J. Kappos
*Director of the United States Patent and Trademark Office*